US006343553B1

(12) United States Patent
O'Dwyer

(10) Patent No.: US 6,343,553 B1
(45) Date of Patent: Feb. 5, 2002

(54) FIREARMS

(75) Inventor: James Michael O'Dwyer, Brisbane (AU)

(73) Assignee: Metal Storm Limited, Brisbane (AU)

( * ) Notice: Subject to any disclaimer, the term of this patent is extended or adjusted under 35 U.S.C. 154(b) by 0 days.

(21) Appl. No.: 09/424,989

(22) PCT Filed: Jun. 1, 1998

(86) PCT No.: PCT/AU98/00409

§ 371 Date: Dec. 3, 1999

§ 102(e) Date: Dec. 3, 1999

(87) PCT Pub. No.: WO98/55824

PCT Pub. Date: Dec. 10, 1998

(30) Foreign Application Priority Data

Jun. 3, 1997 (AU) ..... PO7158

(51) Int. Cl.[7] ..... F42B 14/00; F42B 5/03

(52) U.S. Cl. ..... 102/438; 102/430; 102/431; 102/526; 42/51; 42/84; 89/1.3

(58) Field of Search ..... 102/345, 352, 102/360, 430, 431, 432, 438, 520, 524–527; 42/51, 84; 89/1.3

(56) References Cited

U.S. PATENT DOCUMENTS

| | | | | |
|---|---|---|---|---|
| 58,783 A | * 10/1866 | Currie | 102/526 |
| 2,313,030 A | * 3/1943 | Tauschek | 42/84 |
| 3,169,333 A | * 2/1965 | Scanlon, Jr. | 42/84 |
| 4,552,071 A | * 11/1985 | Horais et al. | 102/524 |

FOREIGN PATENT DOCUMENTS

| | | |
|---|---|---|
| WO | WO 94/20809 | 9/1994 |
| WO | WO 97/04281 | 2/1997 |

* cited by examiner

*Primary Examiner*—Harold J. Tudor
(74) *Attorney, Agent, or Firm*—Oblon, Spivak, McClelland, Maier & Neustadt, P.C.

(57) ABSTRACT

This invention provides a projectile assembly (10) having a body part (14) including a trailing portion (19) which reduces in diameter rearwardly and supports a sealing band (16) having a substantially cylindrical outer face for engagement with the bore (21) of the barrel (11). The body part (14) may move rearwardly through the sealing band (16) to expand it outwardly into sealing engagement with the bore (21). Upon firing the body part (14) moves forwardly relative to the sealing band (16) to free it from the bore (21).

10 Claims, 3 Drawing Sheets

FIREARMS

TECHNICAL FIELD

Figure 1:
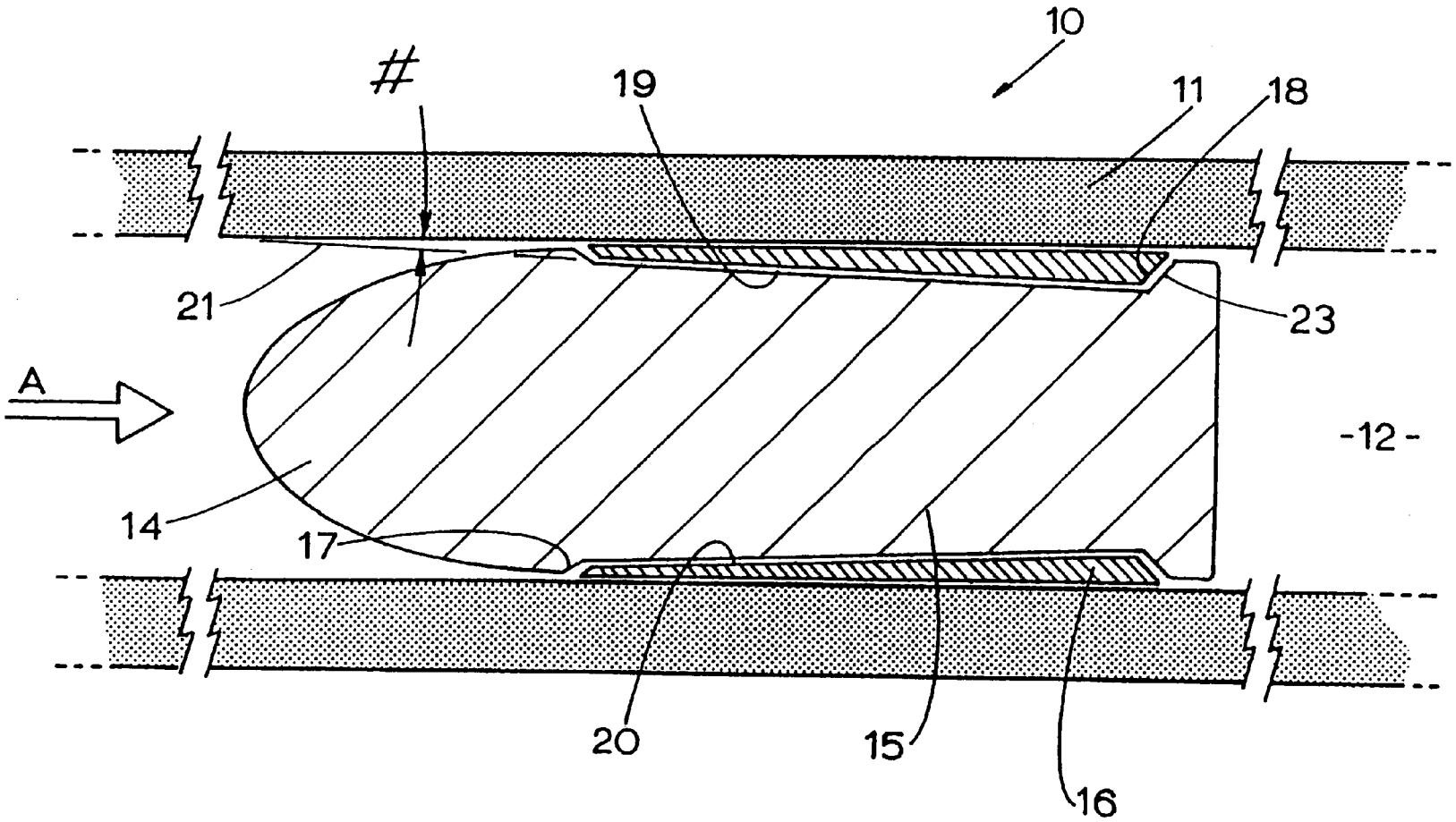

The invention relates to munitions and firearms.

This invention has particular, but not exclusive, application to barrels each having a plurality of projectiles stacked axially within the barrel together with discrete selectively ignitable propellant charges for propelling the projectiles sequentially through the muzzle of the barrel and the sealing engagement between projectiles and barrel being such as to prevent rearward travel of the ignited propellant charge to trailing propellant charges. Such barrels will be referred to hereinafter as of the type described.

BACKGROUND ART

This invention has particular application to munitions and firearms inventions described in my earlier International Patent Applications Nos. PCT/AU94/00124 and PCT/AU96/00459 and my co-pending patent applications.

In my earlier International Patent Application No. PCT/AU96/00459 there is described a wedging action between the head part and the anvil part which effects a seal during firing. This seal ensures minimum loss of propellant past the projectile and maintains a seal between the next projectile and the barrel so that the ignited propellant does not pass the next remaining projectile and cause ignition of the propellant charge therebehind.

The head part is generally made from a softer material than the anvil portion which expands rearwardly so that during loading the head part is forced back over the anvil portion to wedge into sealing engagement with the bore.

If the angle # between the wedging parts and the bore is reduced such as to achieve a greater engagement pressure between the head part and the bore, the pressure that is transmitted to the bore upon firing by the wedging action increases. A point will be reached where the locking of the collar section against the bore of the barrel will be such that the spine and anvil part will swage through the nose of the collar section/head part, which may, as a result be spread up the barrel.

Also the added locking effect, before such a failure, may result in very high pressures within the barrel and possible barrel damage. While no jamming of rounds has been experienced to date it is considered that this possibility needs to be addressed, especially if high barrel pressures in the order of 60,000 psi plus are to be utilised. The present systems are intended to operate with a maximum internal pressure in the order of 40,000 psi chamber pressure.

Also illustrated in PCT/AU96/00459 is a reverse wedging arrangement between the spine and sealing means. However this arrangement utilises interlocking between collars on the sealing portion and recesses formed in the bore.

The bore recesses provide location of the projectile in a fixed position and assist in forming the gas seal during firing of the projectile freed from the recesses and locate the sealing portion during loading to enable the anvil portion to be forced rearwardly relative to the sealing portion to wedge each following projectile into a blocking arrangement in the barrel in front of its propellant charge. While this was previously understood to be necessary it resulted in a series of undesirable peripheral recesses in the bore.

This invention also aims to provide sealing means for effecting an operative seal between a projectile and its supporting barrel which will be efficient in terms of releasing for firing and for prevention of rearward travel of propellant ignited gases past a following projectile to be fired.

DISCLOSURE OF INVENTION

With the foregoing in view, this invention in one aspect resides broadly in a barrel assembly of the type described wherein each projectile has a body portion including a nose portion and a trailing portion which reduces in diameter rearwardly from said nose portion and a sealing band surrounding said trailing portion and having a substantially cylindrical outer face for engagement with the bore of the barrel and an inner face complementary to the trailing portion whereby the body portion may move rearwardly through the sealing portion to expand it outwardly into engagement with the barrel bore.

The trailing portion may reduces in steps from the nose portion or it may tapered to form a part-conical trailing surface. Preferably the nose portion is bullet shaped and has a major diameter just less than the barrel bore diameter and the trailing portion extends rearwardly from a return collar at the rear end of the nose portion or like reduction in body diameter.

Where the sealing band has a complementary part-conical inner face this ensures that the sealing band does not feather to a fine leading edge. It also provides sufficient radial space for positioning a sufficiently robust seal which will resist combustion pressures.

The rear end of the body portion may be terminated by a shoulder defining the rear limit of movement of the sealing band along the body portion. The shoulder may be utilised as a retainer to retain the sealing band on the body portion and if desired the shoulder may expand rearwardly at a relatively steep angle to match the correspondingly tapered rear inner surface of the sealing band so that upon firing at least the rear end of the sealing band is partially wedged into sealing contact with the bore.

The engagement of the shoulder could be arranged to be insufficient to lock the projectile through the sealing band but sufficient to deliver some resistance to forward movement, which can assist with the burn characteristics of the propellant charge. The shoulder may be a converging shape to engage with an outer end face of the projectile to reduce such resistance, as may be appropriate with certain projectiles. Alternatively the tapered trailing portion may extend to the rear end of the body portion.

Preferably the included angle # between the complementary tapered part-conical surfaces and the barrel bore is in the range of 5 degrees and 25 degrees and the medial wall thickness of the sealing band is less than one quarter the diameter of the barrel bore and more preferable less that one eighth the barrel bore diameter, particularly for high pressure applications where internal pressures may reach 90,000 psi. For low pressure applications of up to 40,000 psi, the range may be in the order of 5 degrees to 35 degrees. It is also preferred that the sealing band has a length in excess of half the length of the body portion.

For low pressure applications the sealing band may be in the form of a resilient sealing ring mounted on a stepped rearwardly reducing trailing portion such that it may expand stepwise into sealing engagement with the barrel bore and release stepwise upon firing. The steps may include intermediate ridges to prevent release of the sealing ring beyond an effective sealing position upon firing. Furthermore the outer cylindrical surface of the sealing band or ring may be provided with a groove or grooves in the form of a labyrinth seal.

The body portion and the sealing band may be formed of the same material but preferably the body portion is formed from a harder material than the sealing band.

DESCRIPTION OF PREFERRED EMBODIMENTS

Figure 2A:
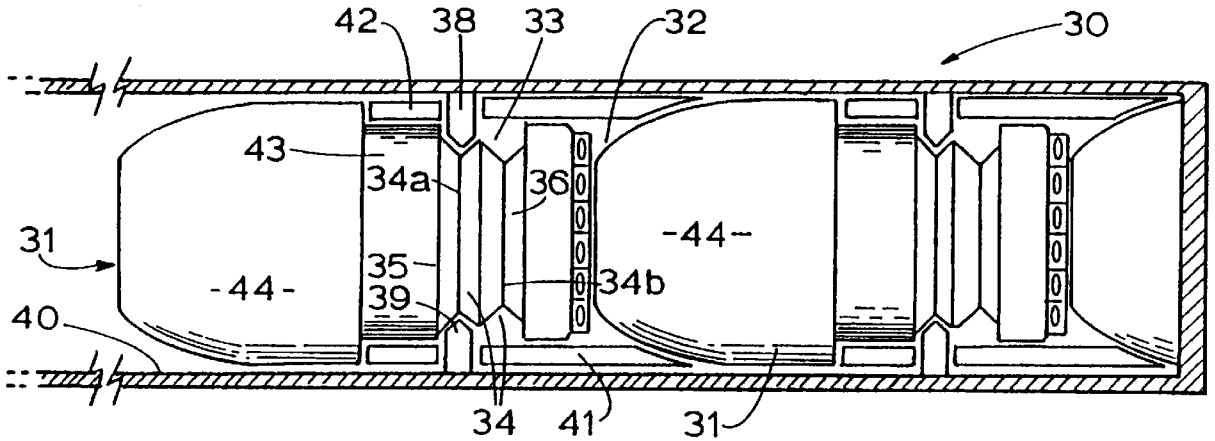
Figure 2B:
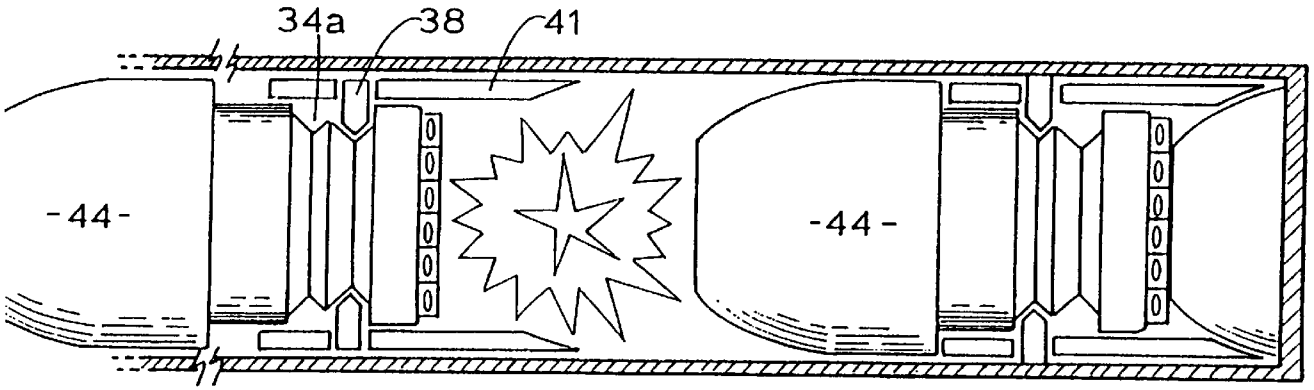
Figure 3:
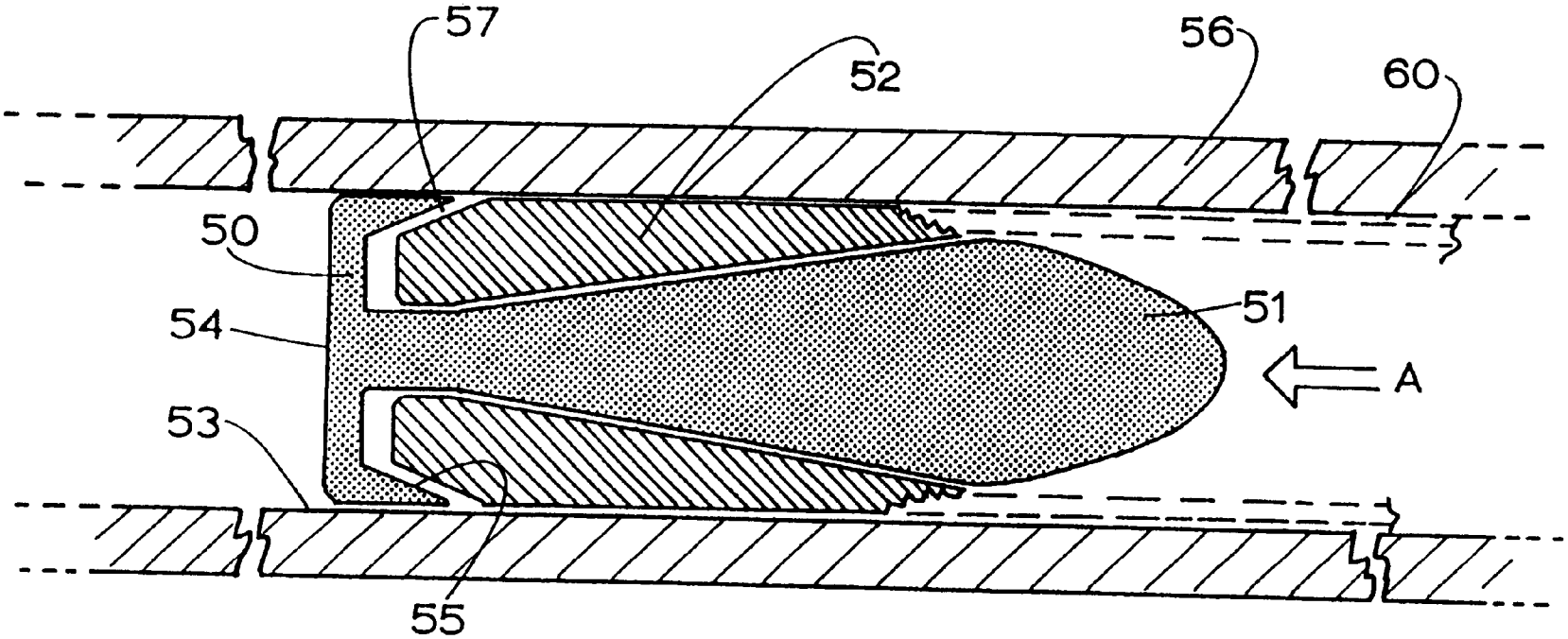

In order that this invention may be more readily understood and put into practical effect, reference will now be made to the accompanying drawings which illustrate typical embodiments of the invention, wherein:

FIG. 1 is a diagrammatic cut-away view of a typical reverse wedging projectile according to one aspect of this invention;

FIGS. 2A and 2B diagrammatically illustrate operation of a further reverse wedging projectile according to another aspect of this invention, and FIG. 3 diagrammatically illustrates a further reverse wedging projectile according to yet another aspect of this invention.

According to the embodiment illustrated in FIG. 1, each projectile assembly 10 in a barrel of the type described is supported in a barrel 11 together with propellant in the trailing space 12 immediately behind the projectile assembly 10.

Each projectile assembly 10 includes a generally bullet shaped body part 14 having a part-conical rearwardly reducing trailing portion 15 which has an outer surface 19 which tapers inwardly slightly towards its trailing end from a returned inclined collar 17. A complementary tapered sealing band 16 is supported on the trailing portion 15. The band has free travel space at each end of the trailing portion 15 such that it may move to and fro to engage and operative disengage therefrom.

The trailing inner face 18 of the sealing band 16 is oppositely tapered to its leading inner face 20 and at a relatively sharp angle and it is spaced from the correspondingly tapered rear shoulder 23 of the trailing portion 15. The inner face 18 and shoulder 23 are operatively engaged at the commencement of forward movement of the body part 14 as it is propelled through the barrel 11 so as to carry the sealing band 16 with the projectile through the barrel in slightly radially expanded and effective sealing engagement therewith.

When loading, impact applied to the body part 14, provided in the direction 'A' when the projectile is located at the appropriate location within the barrel 11 and provided the sealing band is held, will cause the complementary wedging surfaces 19 and 20 to engage and expand the sealing band 16 outwardly into firm sealing engagement with the bore 21 of the barrel 11, sealing and locating the projectile assembly 10 in place in the barrel 11.

This seal prevents the ignited propellant charge from bypassing the adjacent trailing projectile and igniting its propellant charge, but permits the complementary wedging surfaces 19 and 20 to disengage upon relative forward movement of the body part 14 to an extent which permits the projectile 10 to be propelled through the muzzle by the ignited propellant charge.

For loading purposes a releasable tubular spanner may pass the return collar and be engaged with the leading end of the collar to position it at its desired location in the bore and a hammer could pass through the spanner to impact against the nose. The projectiles could be loaded from the rear and a tubular spanner could pass beyond the shoulder to hold the sealing band in position. Then again the propellant charge may be of solid block form with a protruding tubular front portion arranged to locate the sealing band while it is wedged in place.

Such projectiles would have the advantage of allowing the use of a very shallow wedge angle, and consequently higher locking pressures which are needed at higher chamber pressures. However with the wedging action angle reversed, the potential problems inherent in a forward wedging arrangement would be minimised due to release of the locking pressure upon firing. Furthermore, in this configuration the bulk of the projectile is available for preferred-effect materials.

FIGS. 2A and 2B illustrate a barrel 30 containing a grenade type projectile 31 stacked nose to tail and leaving only a small space 32 for propellant. Thus, only relatively low pressures are developed within the barrel and thereby, sealing is more easily achieved. However, sealing must be effective and able to be effective during loading.

For this purpose each projectile 31 has an inwardly stepped trailing portion 33 formed by a series of reducing V-shaped grooves 34 extending from a returned collar 35 and terminated by a tapered shoulder 36. In this embodiment there are two grooves 34*a* and 34*b*, the rear one 34*b* forming the inner part of the rear shoulder 36.

A resilient sealing ring 38 with a V-shaped inner face 39 is normally located in the smaller diameter rear groove 34*b*, in which position the non-expanded ring 38 slides freely within the bore 40.

A skirt 41 having a head part 42 supported slidably on the land 43 extends past the sealing ring, either through gaps in the outer face thereof or through apertures formed therethrough, to engage with the nose 44 of the next projectile so as to position the projectiles 31 in the bore. The sealing ring 38 may be formed of an electrically conductive material and may be used to form on contact of the electrical circuit utilised to ignite the propellant charge.

During loading, after the skirt 41 contacts the nose 44 of an already loaded projectile 31, a force is applied to the nose 44 of the projectile being loaded so as to force the sealing ring 38 into the leading groove 34*a* whereby it is expanded into tight sealing contact with the barrel to effect the necessary seal. Subsequently upon firing, the initial forward movement of the projectile may dislodge the sealing ring 38 back into the trailing groove 38*b* where it may ramp up along the tapered shoulder to cooperate with the skirt 41 and maintain an effective seal with the bore 40. However it is more likely that the sealing ring 38 in its relaxed position located in the groove 38*b* will be just less than the bore diameter. However it is likely that the skirt tail of the skirt 41 will expand under firing pressure and provide the necessary containing means for the ignited propellant and limiting leakage past the projectile 31. For this purpose, the skirt 41 may be made of reinforced nylon.

In the embodiment illustrated in FIG. 3 the rear shoulder 50 of the body portion 51 extends outwardly and forwardly at 55 to engage with a complementary tapered outer rear surface 57 of the sealing band 52 so as to present a full rear face 54 to the propellant and upon firing to capture the rear end of the sealing band 52 to move it out of tight engagement with the bore 53 of the barrel 56.

This embodiment has a relatively large sealing band 52 formed of malleable material such as lead and is particularly suited to applications utilising low propellant pressures. It also provides better access to the front end of the sealing band for engagement of a loading tube such as is illustrated in dotted outline at 60 adapted for screw on engagement with the sealing band 52.

The various forms of projectiles can be utilised with a smooth bore barrel or a rifled barrel. Suitably rifling would run the full length of the barrel, with the projectile rifling being precut so that the insitu projectiles marry with the rifling in the barrel. The various forms of projectiles also have the advantage that during forward movement through the barrel the sealing is not forced into engagement with the barrel. Furthermore all firing pressures act to seal and lock the trailing projectile and unlock the leading projectile. Thus such projectiles may be loaded without a spine extension to maintain separation within the barrel.

Additionally it is considered that in such projectiles both the body portion and the sealing portion can be made of hard metal including softer metal or non-metal inserts or coatings forming seals. Preferably the materials are chosen so that the frictional locking between the mating wedging surfaces of the projectile is less than frictional locking between the sealing portion and the bore of the barrel to assist in the unlocking process.

Multiple wedging bands may also be utilised if desired to enable smaller sealing portions to be used and to reduce resistance to unlocking. Furthermore, split-ring type sealing bands may be used, and these may be biassed into engagement with the bore in their free state or biassed into a contracted attitude about the complementary wedging surface of the body portion and moved outwardly only by the wedging action.

It will of course be realised that the above has been given only by way of illustrative example of the invention and that all such modifications and variations thereto as would be apparent to persons skilled in the art are deemed to fall within the broad scope and ambit of the invention as is defined in the appended claims.

The claims defining the invention are as follows:

1. A barrel assembly comprising:

a barrel;

a plurality of projectiles axially disposed within the barrel for operative sealing engagement with a bore of the barrel; and a plurality of discrete propellant charges for propelling each projectile of the plurality of projectiles sequentially through a muzzle of the barrel;

wherein each projectile of the plurality of projectiles includes a body portion having:

a nose portion, a trailing portion tapering in diameter from a front to a rear of the nose portion, and a sealing band surrounding the trailing portion, the sealing band having a substantially cylindrical outer face for engagement with the bore of the barrel, and an inner face complementary to the trailing portion, whereby the body portion moves rearwardly through the sealing portion in order to expand the sealing portion outwardly into engagement with the bore of the barrel so that the sealing band engages the barrel in response to a detonation of a propellant charge in front of a respective projectile of the plurality of projectiles.

2. The barrel assembly as claimed in claim 1, wherein the trailing portion has a plurality of V-shaped grooves therein.

3. The barrel assembly as claimed in claim 1, wherein the trailing portion tapers to form a frusto-conical trailing surface.

4. The barrel assembly as claimed in claim 1 or claim 2, wherein the trailing portion extends rearwardly from a return collar on the body portion.

5. The barrel assembly as claimed in claim 3, wherein the sealing band has a complementary frusto-conical inner face.

6. The barrel assembly as claimed in claim 5, wherein:

an included angle, between the bore of the barrel and complementarily tapered part-conical surfaces, is in a range of approximately 5 degrees to approximately 35 degrees; and a medial wall thickness of the sealing band is less than one quarter of a diameter of the bore of the barrel.

7. The barrel assembly as claimed in claim 1, wherein a rear end of the body ends in a shoulder which defines a limit as to a rear movement of the sealing band along the body portion.

8. The barrel assembly as claimed in claim 7 wherein the shoulder expands rearwardly at a relatively steep angle to match a correspondingly tapered rear inner surface of the sealing band.

9. The barrel assembly as claimed in claim 2, wherein the sealing band is a resilient sealing ring mounted on the trailing portion.

10. The barrel assembly as claimed in claim 2, wherein the V-shaped grooves include intermediate ridges.

* * * * *